US006236305B1

(12) United States Patent
Martin

(10) Patent No.: US 6,236,305 B1
(45) Date of Patent: May 22, 2001

(54) INTERCHANGEABLE SOUND EFFECT DEVICE

(76) Inventor: Frank A. Martin, 3821 Thrush Way, Santa Clara, CA (US) 95051

( * ) Notice: Subject to any disclaimer, the term of this patent is extended or adjusted under 35 U.S.C. 154(b) by 0 days.

This patent is subject to a terminal disclaimer.

(21) Appl. No.: 09/542,208

(22) Filed: Apr. 4, 2000

Related U.S. Application Data

(63) Continuation of application No. 09/211,299, filed on Dec. 14, 1998, now Pat. No. 6,046,670, which is a continuation of application No. PCT/US96/10394, filed on Jun. 14, 1996.

(51) Int. Cl.[7] ..... G08B 3/10

(52) U.S. Cl. ..... 340/384.3; 340/384.73; 446/302; 446/404; 446/484

(58) Field of Search ..... 340/384.3, 384.1, 340/384.7, 384.73; 446/299, 302, 404, 484, 408

(56) References Cited

U.S. PATENT DOCUMENTS

| | | | | |
|---|---|---|---|---|
| 4,923,428 | * | 5/1990 | Curran | 446/175 |
| 5,073,140 | * | 12/1991 | Lebensfeld et al. | 446/297 |
| 5,092,810 | * | 3/1992 | Kwan et al. | 446/268 |
| 5,195,920 | * | 3/1993 | Collier | 446/409 |
| 5,237,617 | * | 8/1993 | Miller | 381/61 |
| 5,485,068 | * | 1/1996 | Vaught | 318/568.1 |
| 5,636,995 | * | 6/1997 | Sharpe, III et al. | 434/317 |
| 5,648,753 | * | 7/1997 | Martin | 340/384.1 |
| 5,851,119 | * | 12/1998 | Sharpe, III et al. | 434/317 |
| 6,046,670 | * | 4/2000 | Martin | 340/384.3 |

* cited by examiner

*Primary Examiner*—Jeffery Hofsass
*Assistant Examiner*—Toan Pham
(74) *Attorney, Agent, or Firm*—Carol D. Titus; James J. Leary

(57) ABSTRACT

An interchangeable sound effect device (1) that incorporates and plays sound effects that have been digitally recorded on interchangeable sound cartridges (4). This device (1) is designed to be used with entertainment and educational type products such as toys, dolls, figurines, books and instructional guides. The sound effect device (1) employs an infrared receiver (28) housed within a durable encasement that straps around the user's waist or is embedded within the doll, figurine, toy, or book. The receiver unit (28) contains an infrared detector (44), an electronic diving means (60), an audio speaker (52), and a sound cartridge (4) that rests within a sound cartridge chamber (32). The sound cartridge (4) contains a sound enabler chip (12) that stores, in digital form, a number of prerecorded sound effects. In addition, the user can easily remove the sound cartridge (4) and insert one of many other sound cartridges each containing a different set of sound effects. Finally, the sound effect device (1) uses an infrared transmitter (76) that attaches to an adjustable glove (92). This transmitter (76) contains several buttons (80) that the user presses to select the desired sound effect. When the user actuates a button (80), the transmitter (76) directs an infrared signal indicative of a sound effect to the receiver (28) which will in tun access the sound enabler chip (12) and play the sound effect. In another embodiment, the transmitter (76) and receiver (28) functions are eliminated and the sound effect device (1) is contained within a single housing unit (120) that would be physically incorporated into the doll, toy, book, etc. for convenience. The one-piece embodiment (120) also employs easy to use, interchangeable sound cartridges (4) and the user would operate both embodiments in the same manner.

26 Claims, 10 Drawing Sheets

FLOW CHART OF CODE FOR COMBINED SYSTEM

INTERCHANGEABLE SOUND EFFECT DEVICE

CROSS REFERENCE TO OTHER APPLICATIONS

This application is a continuation of U.S. patent application Ser. No. 09/211,299, filed Dec. 14, 1998, now U.S. Pat. No. 6,046,670, which is a National Stage Application of International Application PCT/US96/10394, filed Jun. 14, 1996.

FIELD OF THE INVENTION

This invention relates in general to sound effect devices and more specifically, to a user controlled sound device that will allow the user to play a wide variety of sound effects which are stored on interchangeable sound cartridges.

BACKGROUND

At the present time, there are a wide variety of sound effect devices designed within dolls, figurines, toys and the like. These sound effects are usually of poor quality and add to the cost of the toy. Furthermore, many toys are not equipped with sound effects. If a child possesses a wide variety of toys (toy guns, dolls, space ships, cars, dinosaurs, figurines, etc. . . . ) not equipped with sound effects, the child must improvise by creating his/her own sound effects. Currently, there are no sound effect devices that provide sounds for dolls, figurines, toys and the like that are not otherwise equipped with sound effect devices. In addition, those dolls, figurines, toys and the like that are equipped with sound effect devices are limited to the sound effects provided by the manufacturer.

Heretofore, inventors have modified a variety of sound devices. See, for example, U.S. Pat. Nos. 5,253,068; 4,337,460; 5,177,467; 4,314,236; and 5,130,693. All of these inventions provide different sound effects for various purposes. However, these devices are not designed to provide sound effects for dolls, figurines, toys and the like and they suffer many other disadvantages that inhibit their full commercial acceptance.

For example, there are many toys for sale in today's market, however, none of the prior art sound effect devices provide the user with the ability to change or add extra sounds to a toy's given list of sound effects. In other words, the toy is limited to the sound effects contained inside the toy as provided by the manufacturer. Second, when a child plays with a toy that contains sound effects, it is often difficult and disruptive for the child to manually push buttons on the object and play at the same time. Prior art designs simply do not allow the user to control the sound effects while playing with the toy in a more natural, realistic manner. In addition, such toys do not help develop the child's hand-eye coordination. Another disadvantage of prior art designs is the relatively poor sound quality. A majority of the sound effects associated with prior art designs are electronically simulated sounds; they are not prerecorded "real sounds." Thus, the sounds produced provide little realism.

SUMMARY OF THE INVENTION

The present invention describes a device that produces sound effects that are primarily intended for use with dolls, figurines, toys, and educational materials such as books and guides. The sound effects are digitally prerecorded and stored on small, easily removable cartridges that can be exchanged with other cartridges, each containing a different set of prerecorded sounds. In the preferred embodiment, the user controls the sounds by actuating a number of buttons on a transmitter unit that is contained in an ambidextrous, glove-like garment which is worn by the user. The transmitter sends an infrared signal to a receiver unit that is collocated with the sound cartridge. The receiver unit can be designed so that it is physically part of the toy or it can be worn on the user's waist in the event the doll, toy, or book, as manufactured, has no sound effect capabilities. Accordingly, there are several options, advantage, and cost benefits associated with the present invention that one cannot attribute to any of the prior art.

It is one object of the present invention to provide a device that allows the user to play with any doll, toy, figurine, book or the like by enhancing those toys and books with realistic sound effects where none existed before.

It is another object to provide a device that allows the user to play with any doll, toy, figurine, book, or the like and add sound effects when there are but a few limited sound effects provided by the manufacturer.

It is another object to provide a design that allows the user to control the sound effects during play without having to stop and interrupt play.

Another object is to provide quality sound effects in order to educate and enrich the user's imagination.

It is yet another object to generate as many sound effects as possible by providing interchangeable sound cartridge units, each containing a different though related set of sound effects.

Still another object is to provide a device that will aid in improving the user's hand-eye coordination by using this device.

Another object is to provide a unit that can be designed into other toys and the like that do not have the flexibility of using interchangeable sound effects.

It is also an object to provide a unit that can be designed into educational and informational material (i.e. books and guides) that do not have the flexibility of using interchangeable sound effects.

It is another object to provide a device that is easy to use and one that employs a cost saving approach since only one sound effect device is needed to play back a wide variety of sound effects.

Another object is to provide a unit that provides interchangeable sound cartridges that lock firmly and connect effectively to the circuit.

Another object is to provide a protective cartridge that protects the sound enabler from damage and electrostatic discharge from the user.

Finally, it is an object to provide a device that is lightweight and easy to carry.

DETAILED DESCRIPTION OF THE INVENTION

Physical Description of a Two-Piece Embodiment

Figure 1:
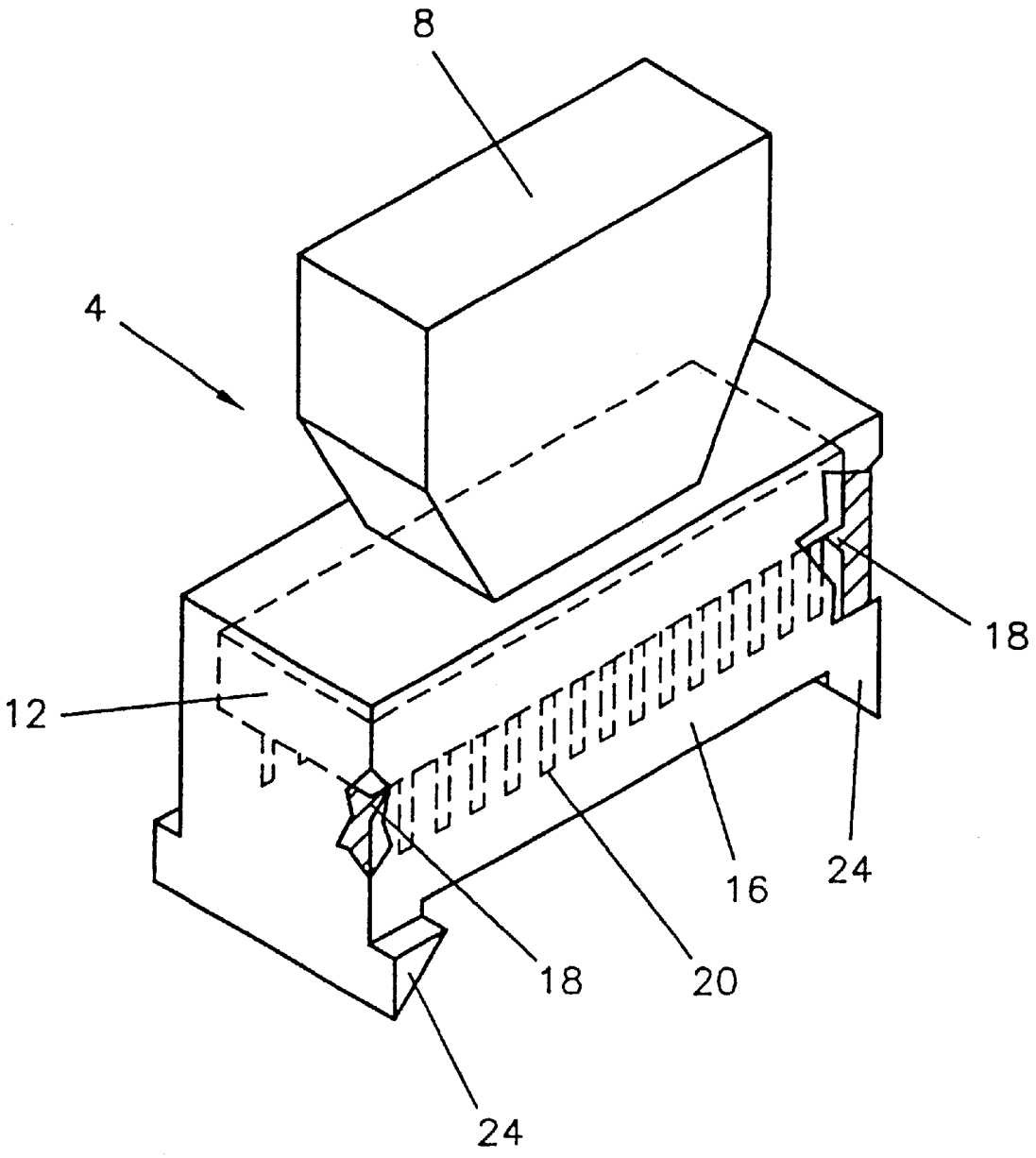
FIG. 1 shows a perspective view of the sound component of the present invention.
Figure 2:
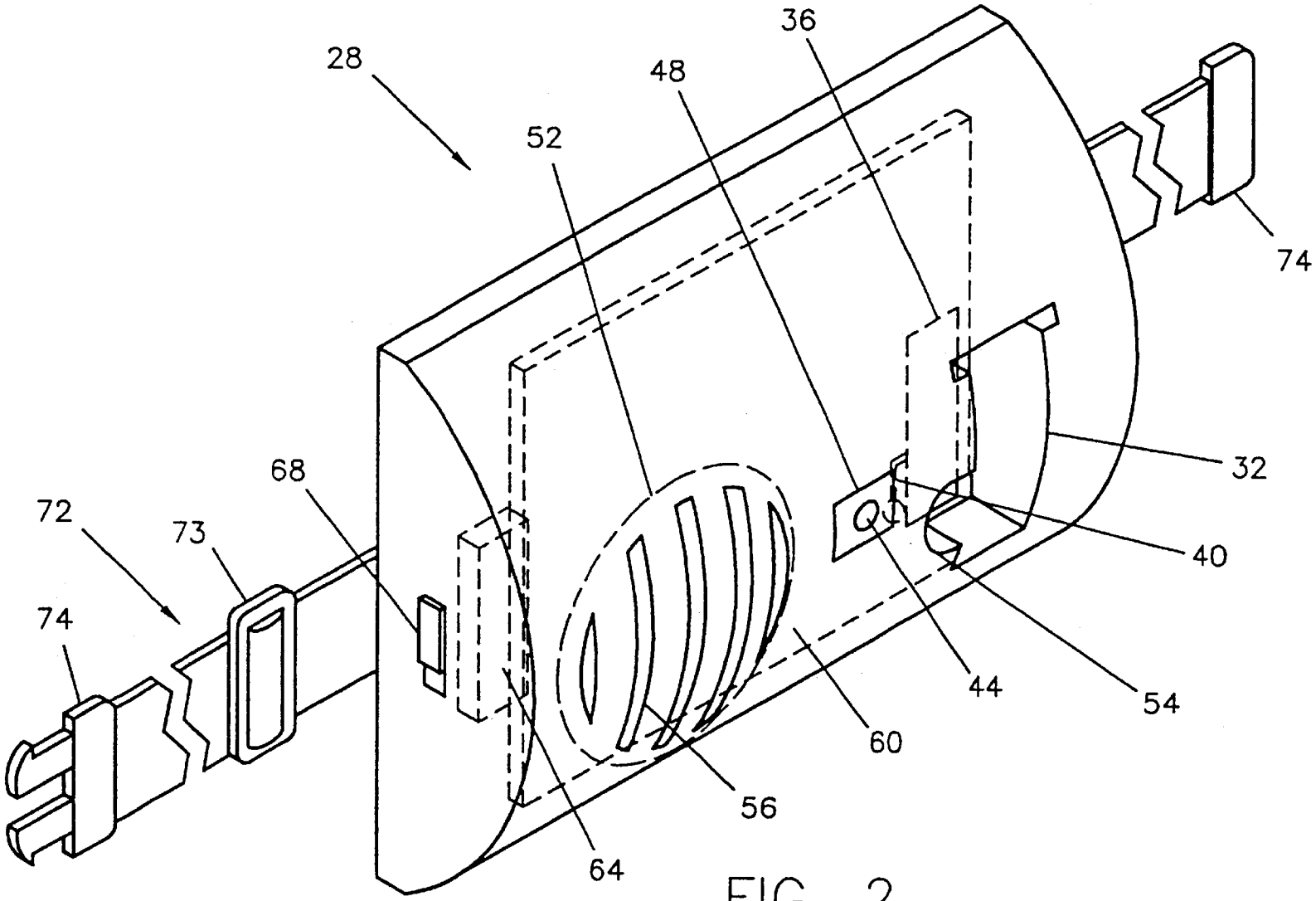
FIG. 2 shows a perspective view of the receiving component of the present invention.
Figure 3:
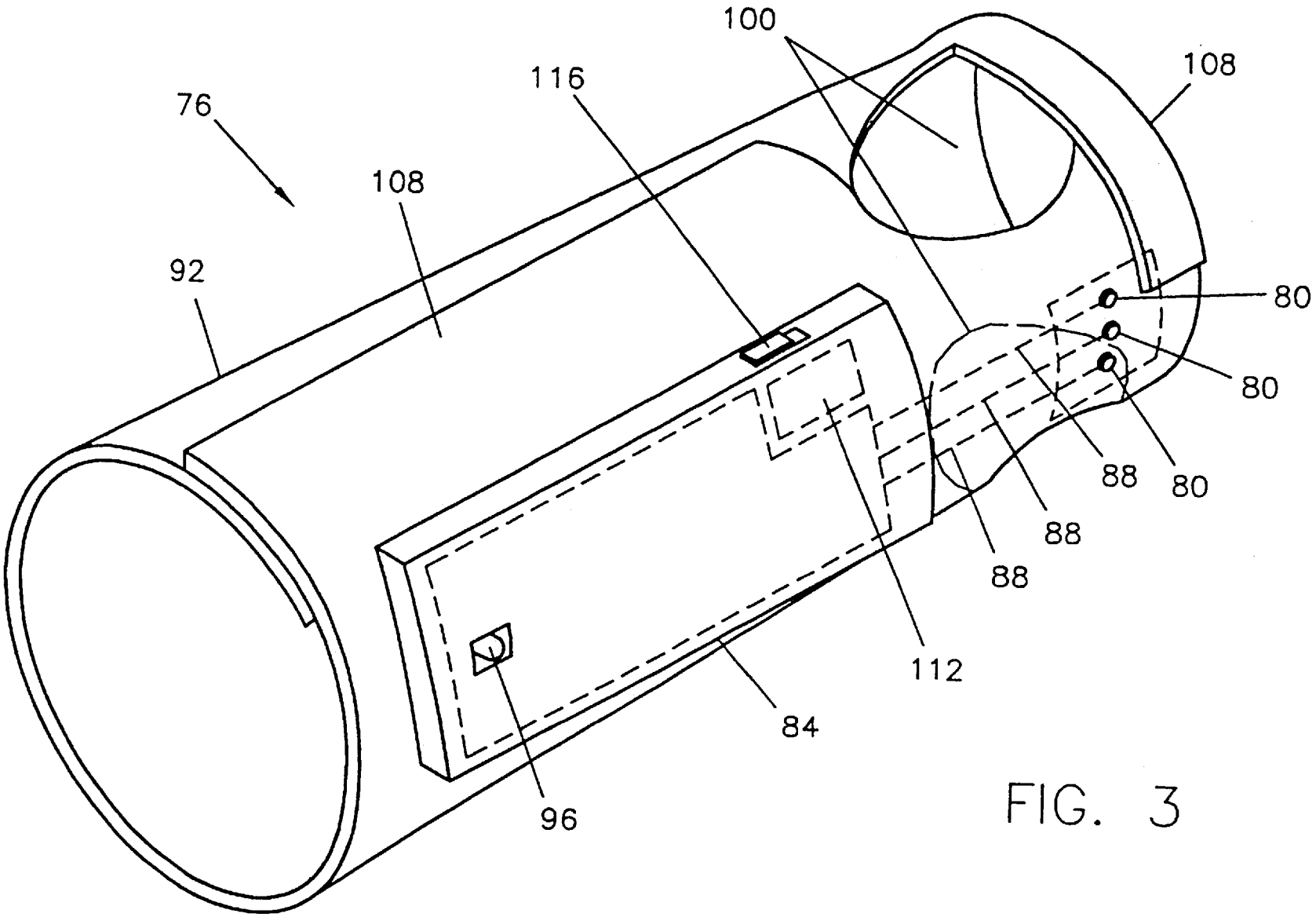
FIG. 3 shows a perspective view of the transmitting component of the present invention.

FIGS. 1, 2 and 3 show the three major components of this invention. In general, the three components are referred to as the sound cartridge 4, the receiver 28 and the transmitter 76. The first component, sound cartridge 4, consists of a rectangular, plug in style housing unit for the sound enabler 12. Sound cartridge 4 should be made from nonconductive durable plastic in order to protect sound enabler 12 from damage and electrostatic discharge from the user. On the top of sound cartridge 4 is the handle 8. Handle 8 is square in shape and tapers as it forms to the center of the housing unit 16. In addition, handle 8 is designed to allow the user to grasp the sound cartridge 4 between his/her forefinger and thumb. Connected to handle 8 is housing unit 16. Housing unit 16 is rectangular in shape having no bottom wall. Housing unit 16 is designed to encompass and protect sound enabler 12 from damage. The length of housing unit 16 should extend past the connector extension(s) 20. This length can vary depending on both the size, and make of sound enabler 12 and connector extension(s) 20. Within the left and right side of housing unit 16 are the holding clamps 18. Holding clamps 18 are designed to secure sound enabler 12 within housing unit 16. Holding clamps 18 should be designed to center connector extension(s) 20 within sound cartridge 4 keeping it free from contact of housing unit 16. This will provide for a better connection when inserted into receiver 28. Stemming from the left and right side of housing unit 16 are the insert extension(s) 24. Insert extension(s) 24 were designed as a user control to protect sound enabler 12 from damage. As shown in FIG. 1, one insert extension is wider than the other. This control allows for "one way" insertion of sound cartridge 4 into receiver 28 preventing damage to the sound enabler 12 upon connection.

The second component of the two-piece embodiment is receiver 28. In FIG. 2, receiver 28 has an adjustable belt unit 72 that fits around the user's waist. The shell of receiver 28 is a rectangular shaped box rounded in the front. The shell of receiver 28 should be made from nonconductive durable plastic in order to protect the driving means 60 from damage. On the right side of receiver 28 is the cartridge chamber 32. Within cartridge chamber 32 is the ZIF (Zero Insert Force) socket 36. Both the size of cartridge chamber 32 and ZIF socket 36 can vary depending on the size and make of sound enabler 12 and corresponding connector extensions 20. Cartridge chamber 32 should be sufficient and aligned to accommodate the varying widths of insert extensions 24 in order to allow for "one-way" fit. In addition, cartridge chamber 32, in conjunction with insert extensions 20, should be design to act as a guide for sound enabler 12 to ensure proper position and fit into ZIF socket 36. On the left side of cartridge chamber 32 is the arm lock 40. ZIF socket 36 is equipped with arm lock 40 and allows the user to clamp down and connect sound enabler 12 to driving means 60. Above arm lock 40 is the finger depression 54. Finger depression 54 allows the user to dig his/her finger under the arm lock 40. This will aid the user when lifting arm lock 40 upward to release sound enabler 12 from receiver 28. Finger depression 54 should be designed to allow enough room for the user to wedge his/her finger under arm lock 40 when it's in lock position. On the left side of receiver 28 is the speaker 52. Speaker 52 can vary in size and shape depending on how much amplification the maker intends to provide the user. In addition, speaker 52 should be mounted to fit tightly within receiver 28 in order to reduce distortion and maintain the quality of the sound effects. Above speaker 52 are the slots 56. These slots 56 should be narrow and stretch across conforming to speaker's 52 shape in order to emit sound clearly and audibly from speaker 56. At the center of receiver 28 is the protective cover 48. Protective cover 48 should be clear and flat and made from material such as a plastic or acrylic to enhance the receivability of the transmitter's infrared signal. Under the protective cover 48 is infrared detector 44. Both protective cover 48 and infrared detector 44 should be angled upward in order to receive the infrared signal from multiple angles. Within the left side of the shell of receiver 28 are the power source 64 and the off/on switch 68. The position of power source 64 and off/on switch 68 can vary pending the maker's design.

The third component of this invention is the transmitter 76. Transmitter 76 as shown in FIG. 3, is a hand control unit attached to an ambidextrous glove 92. The top portion of glove 92 has no finger and thumb sheathes. The user will be able to move his/her fingers and thumb freely when wearing the glove 92. Glove 92 should be made from durable non conductive material (e.g. fabric, cloth, neoprene, etc.). To adjust glove 92 to fit the user's hand and forearm, there are Velcro straps 108 located at the top, wrist and bottom section of glove 92. The upper left and right sides of glove 92 are tapered inward to allow for thumb holes 100. The thumb holes 100 are designed for versatility since glove 92 is ambidextrous. At the upper center of glove 92 are three trigger switches 80. The number of trigger switches 80 can vary depending on how many sound effects the maker intends to provide the user. Trigger switches 80 should be positioned to allow the user to depress one of the trigger switches 80 with his/her finger or thumb. Trigger switches 80 should be mounted on the surface of glove 92. Trigger switches 80 can be spring loaded micro-switches having push buttons that protrude outward in the "off" position and are depressed to switch "on" the driving means 84. Tracking down from trigger switches 80 to driving means 84 are flexible connector leads 88. Connector leads 88 should be mounted within glove 92 and made of flexible conductive, insulated wire to allow movement as the user flexes his/her hand. At the end of transmitter 76 is an infrared LED 96 (Light Emitting Diode). Infrared LED 96 should be centered and angled out to transmit the infrared signal clearly to infrared detector 44. At the upper right side of transmitter 76 are the power source 112 and the off/on switch 116. The position of power source 60 and off/on switch 68 can vary depending on the maker's design of driving means 84.

The preferred embodiment described herein uses a transmitter that employs an infrared LED because infrared LED's are effective, reliable, and inexpensive. However, an alternative design could employ a radio frequency or ultrasonic transmitter and receiver. A further variation could use wiring to connect the transmitter unit 76 with the receiver unit 28. Currently the use of phone type wiring is preferred. If desired to facilitate easy hook up, a jack type of connection may be used at one or both ends of the wiring.

Physical Description of a One-Piece Embodiment

Figure 4:
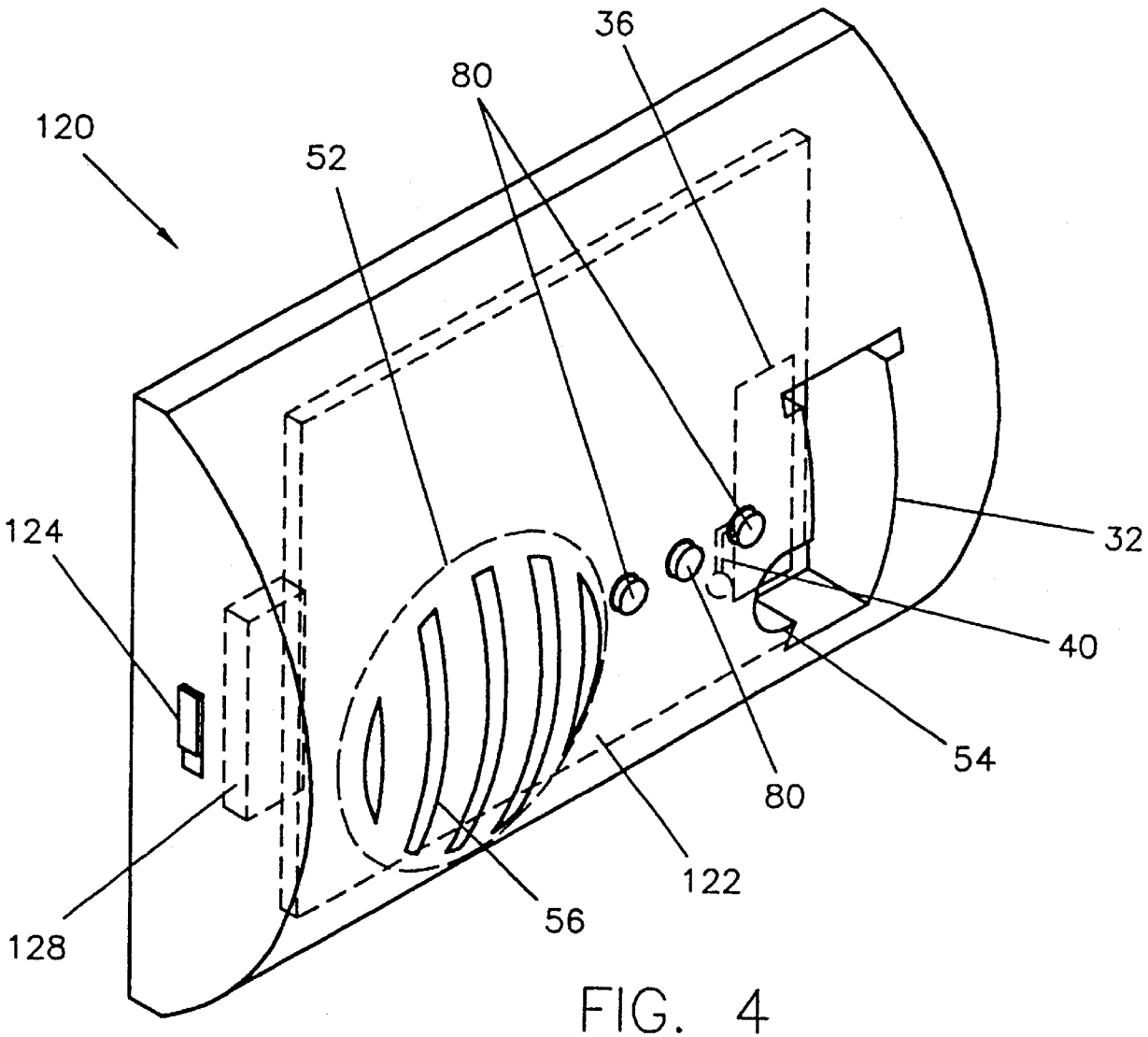
FIG. 4 shows a perspective view of another modification of the present invention.
Figure 5:
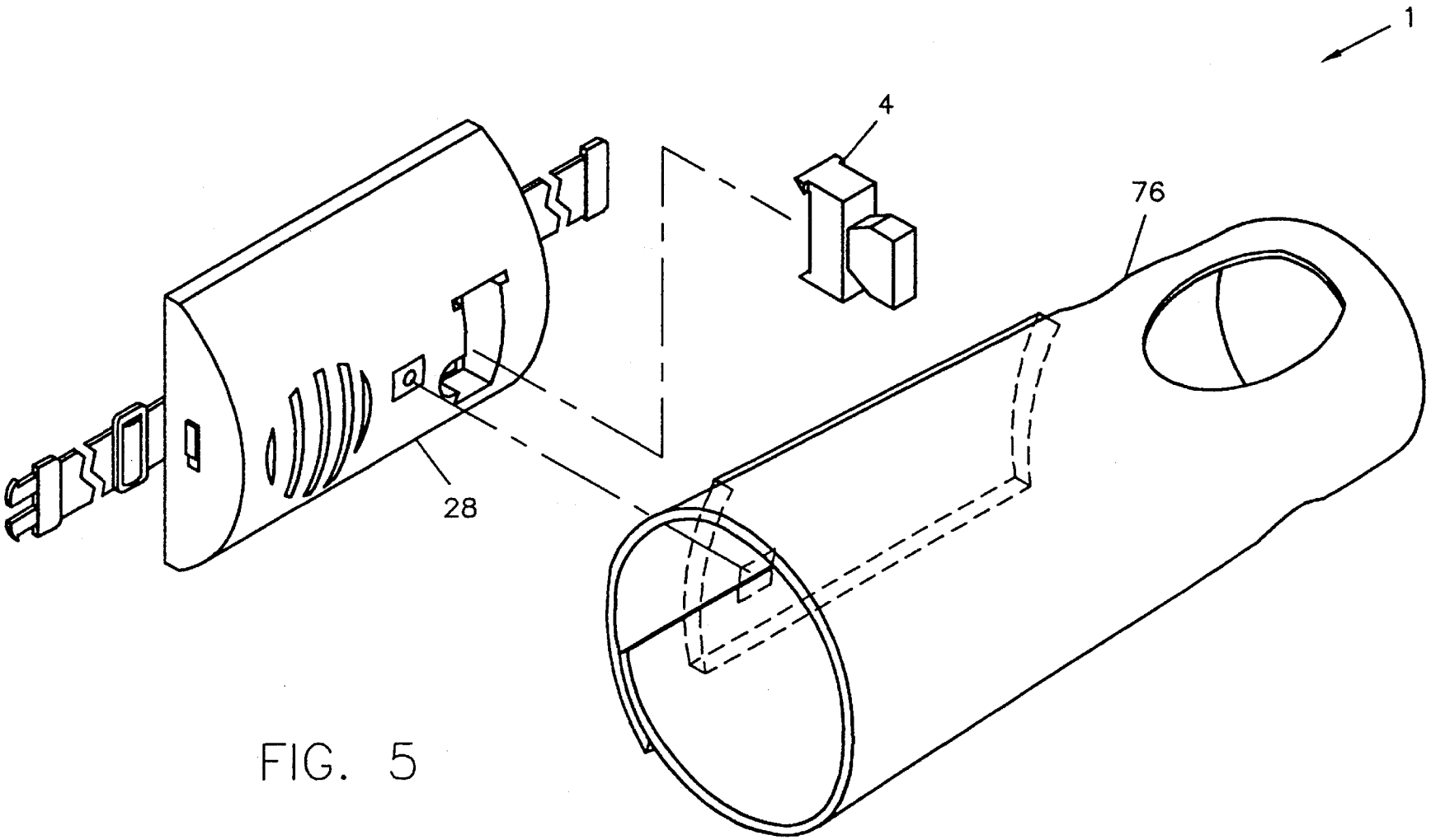
FIG. 5 shows a perspective view of the three components of the present invention in operation.

FIG. 4 shows a one piece embodiment of the invention. The one piece embodiment 120 modification of the sound effect device can be triggered to play any sound effect prerecorded on the sound enabler 12 by depressing the enclosed trigger switches 80. In addition, this device can be mounted on a glove, in toys, or in educational or informational material (e.g. books, guides) thus allowing these items to produce many different sound effects.

With this unit, the number of trigger switches 80 can vary and change depending on how many sound effects the maker intends to provide the user. As shown in FIG. 4, trigger switches 80 are located in the center of one piece embodiment 120. Trigger switches 80 should be positioned to allow the user to depress them with his/her finger and/or thumb. Trigger switches 80 can be spring loaded micro-switches having push buttons that protrude outward in the "off" position and are depressed to switch "on" the driving means 122. On the right side of one piece embodiment 120 is cartridge chamber 32. Within cartridge chamber 32 is ZIF (Zero Insertion Force) socket 36. Both the size of cartridge chamber 32 and ZIF socket 36 can vary depending on the size and make of sound enabler 12 and corresponding connector extensions 20. Cartridge chamber 32 should be sufficient and aligned to accommodate the varying widths of insert extensions 24 in order to allow for "one-way" fit. In addition, cartridge chamber 32, in conjunction with insert extensions 20, should be designed to act as a guide for sound enabler 12 to ensure proper fit into the ZIF socket. On the left side of cartridge chamber 32 is arm lock 40. ZIF socket 36 is equipped with arm lock 40 to allow the user to clamp down and connect sound enabler 12 to one piece embodiment 120. Above arm lock 40 is finger depression 54. Finger depression 54 allows the user to dig his(her finger under arm lock 40. This will aid the user when lifting arm lock 40 upward to release the sound enabler from the one piece embodiment 120. Finger depression 54 should be designed to allow enough room for the user to wedge his/her finger under arm lock 40 when its in lock position. Encased below cartridge chamber 32 is speaker 52. Speaker 52 can vary in size and shape depending on how much amplification the maker intends to provide the user. In addition, speaker 52 should fit tightly within one piece embodiment 120 in order to reduce distortion and maintain the quality of the sound effects. Above speaker 52 are the slots 56. These slots 56 should be narrow and stretch across conforming to the speaker's 52 shape in order that the sound effects emit clearly and audibly from speaker 56. At the left side of one piece embodiment 120 are the power source 112 and the off/on switch 112. The position of power source 128 and off/on switch 124 can vary depending on the maker's design of the driving means 122.

Technical Description

Figure 6:
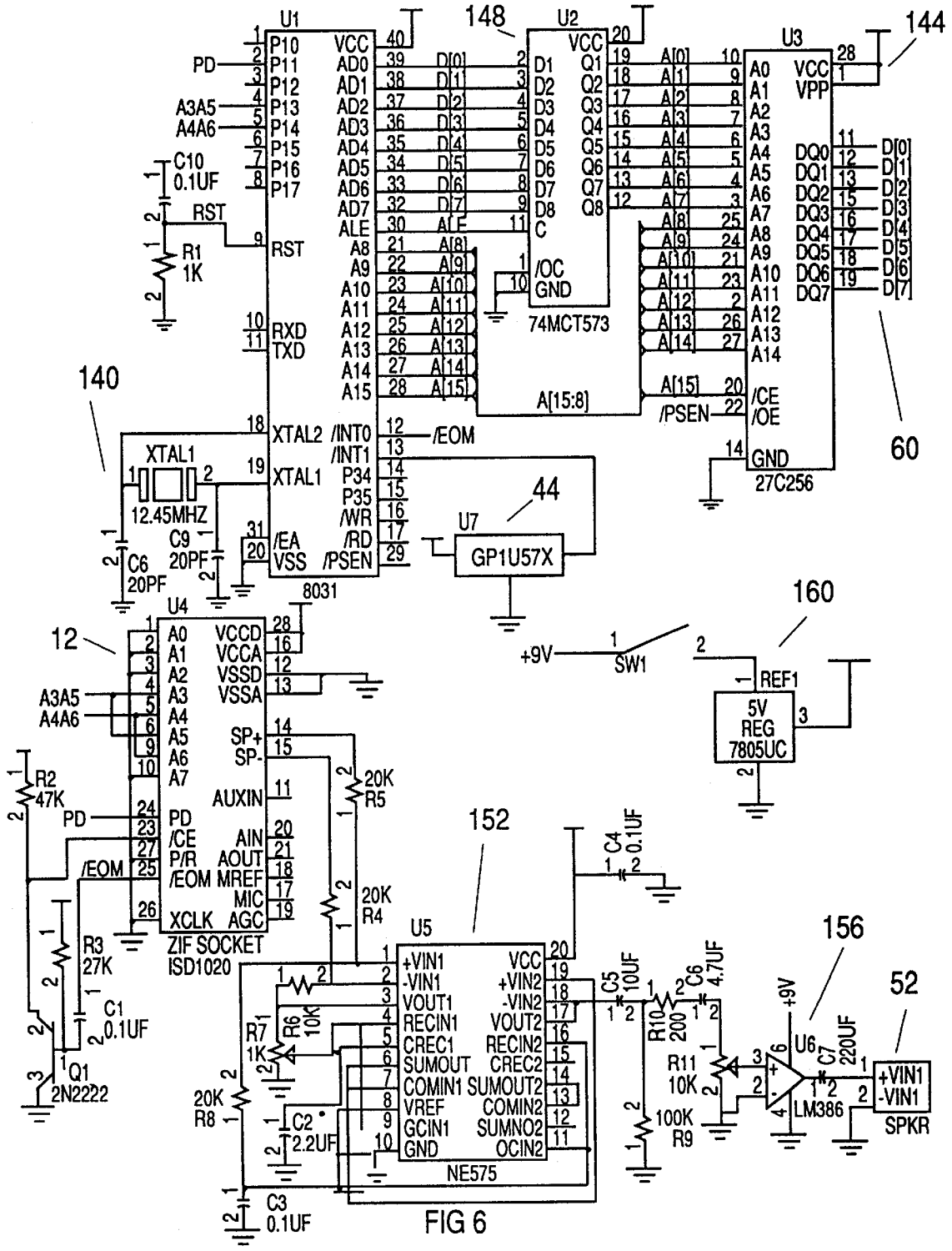
FIG. 6 shows a schematic diagram of the receiver unit of the present invention.

FIG. 6 is a schematic drawing showing the receiver circuitry of the two-piece embodiment. The microcontroller 136 in this application is an Intel 8031 Microcontroller which requires the following circuitry for this application: reset circuitry, external crystal, instruction fetch circuitry, and interrupt circuitry.

In FIG. 6, microcontroller 136 has an on-chip oscillator which is used as the clock source for the central processing unit (CPU). To utilize the on-board oscillator, a crystal resonator 140 must be connected between the XTAL1 and XTAL2 pins on microcontroller 136 and the capacitors C8 and C9. Furthermore, C8 and C9 must be grounded. The crystal resonator used in this design employs a 12 MHz crystal which produces a 1 microsecond machine cycle. In addition, a reset circuit is designed within the receiver circuit to allow microcontroller 136 to function properly when powered up. An automatic reset will be obtained when the VCC is turned on by connecting the RST pin of microcontroller 136 to VCC via C10 and ground via fixed resistance R1. To ensure a proper reset function, the RST pin of microcontroller 136 must remain high during the oscillator start-up time (normally a few microseconds plus two machine cycles (2 ms)).

Instruction Fetch Circuitry allows microcontroller 136 to fetch instructions from the external memory 144 (in this application an AMD 27C256 EPROM was used to store the instructions). To implement, the /EA pin of microcontroller 136 must be tied to ground which causes all program fetches to be directed to external memory 144.

Microcontroller 136 memory is divided into two groups: data memory and program memory (CPU instructions). For this application, all data is stored in the 384 bytes of internal RAM inside microcontroller 136. Thus, the /RD and /WR pins on microcontroller 136 are not connected. Bus functions during program memory fetches are dedicated to the 16 I/O (Input/Output) lines AD0–AD7 and A8–A15 (Address/Data, Address respectively) of microcontroller 136. AD0–AD7 serves as a time-multiplexed address/data bus. These bus lines carry the low byte of the memory address for the Program Counter. The Program Counter is a register that contains the address of the next program instruction. The Program Counter is built within the Intel 8031 Microcontroller. When the low address byte on lines AD0–AD7 is valid, the signal ALE (Address Latch Enable) on microcontroller 136 clocks the byte into an address latch 148 (Texas Instrument 74HCT573). Meanwhile, address lines A8–A15 of microcontroller 136 contains the high address byte for the Program Counter. During this exchange, /PSEN (Program Store Enable) of the external memory 144 strobes the external memory (EPROM) 144 and the code byte is read into microcontroller 136. It must be noted that the Program Memory addresses are always 16 bits wide; however, in this application, A15 is used for the chip select on external memory 144.

The interrupt circuitry utilizes the two external, edge-triggered interrupts /INT1 and /INT0 (Interrupt 1 and Interrupt 0 respectively) on microcontroller 136 and a 16 bit timer built into the 8031 microcontroller. /INT1 of microcontroller 136 is connected to infrared detector 44 (Sharp GP1U57X). When there is no signal detected, infrared detector 44 outputs a high logic voltage level. When an infrared signal is detected, the output logic voltage level of infrared detector 44 is low. The 16 bit timer in microcontroller 136 is activated by /INT1. It is used to measure the width of the interrupt pulse and therefore the frequency of the incoming, infrared signal. The frequency of the incoming signal controls the activation of address lines A3A5 and/or A4A6 on sound enabler 12. The activation of address lines A3A5 and/or A4A6, in turn, controls which sound effect is to be played as described in greater detail below.

Once a sound effect begins playing, microcontroller 136 will not check for another incoming infrared signal until /INT0 occurs. /INT0 is connected to the /EOM (End of Message) pin on sound enabler 12. When the sound effect is complete, the /EOM signal transitions from high to low initiating /INT0. /INT0 then signals microcontroller 136 that it can begin looking for the next incoming infrared signal. This process insures the sound effect device will play the current sound effect to completion.

Sound enabler 12 within the sound cartridge 4 plugs into a 28 pin ZIF (Zero Insert Force) socket 36 within receiver 28. In addition, sound enabler 12 should be positioned within sound cartridge 4 so that pin 1 of sound enabler 12 aligns with pin 1 of ZIF socket 36. This can be accomplished by aligning the pins in sound enabler 12 with the corresponding pins in sound cartridge 4. Since the sound cartridge is designed for "one-way" fit, it will ensure that sound enabler 12 has been inserted correctly into receiver 28. Receiver 28 will be capable of playing a wide variety of sounds since sound cartridge 4 and sound enabler 12 are easily removable from the ZIF socket and exchanged with a new sound cartridge and sound enabler. The sound enabler 12 used in this application (ISD 1020 sound chip) can accommodate up to twenty seconds of recorded sound. In addition, the sound enabler is designed to produce a variety of sound effects by storing each in different memory locations within the sound enabler chip. Sound enabler 12 also has the capability to drive 50 milliwatts into a 16 ohm speaker. In this application, the sound is prerecorded on the sound chip using address lines A3A5 and A4A6. To play a particular sound, as described above, address lines A0–A7 of sound enabler 12 must be set to the corresponding memory address. In this design, address lines A3 and A5 of sound enabler 12 are connected to the A3A5 signal and address lines A4 and A6 are connected to the A4A6 signal of microcontroller 136. The memory map for the sound enabler chip is as follows:

| Message | Message Length | A3A5 Logic Level | A4A6 Logic Level |
|---|---|---|---|
| 1 | 10 sec | 0 | 0 |
| 2 | 5 sec | 0 | 1 |
| 3 | 5 sec | 1 | 1 |

Before the device will play any of the prerecorded sound effects, the PD (Power Down) signal connected to the PD pin on sound enabler 12 must transition from high to low. The A3A5, A4A6, and the PD signals are all connected to Port 1 (pins 1–8) of microcontroller 136, thus microcontroller 136 controls all the signals necessary to produce the sound effects stored in sound enabler 12.

In addition, the design employs "message looping" circuitry for instances where the user plays the same message repeatedly. This circuit uses the /EOM and ICE (Chip Enable) signals of sound enabler 12. As seen in FIG. 6, C1 is connected between the /EOM signal and the base of transistor Q1. In addition, the base of transistor Q1 is connected to VCC via fixed resistance R3. The emitter of transistor Q1 is grounded and the collector of transistor Q1 is connected to VCC via fixed resistance R2 with pin 2 on R2 connected to the /CE of sound enabler 12.

While the message is playing, /EOM is high and transistor Q1 is turned on, causing the /CE pin to remain in a low logic voltage state. At the end of each message, the /EOM signal transitions low. This low signal is coupled through C1 causing transistor Q1 to momentarily turn off. This creates a positive going pulse on the /CE line, in turn, causing sound enabler 12 to momentarily turn off. R3 will then transition the base of transistor Q1 high again, causing transistor Q1 to turn on, which in turn produces a low logic voltage condition on the /CE line. This once again turns on sound enabler 12 which will begin replaying the message located at the address defined by address lines A0–A7, or in reality, A3, A5, A4, and A6. Of course, this assumes that address lines A0–A7 have not changed.

To filter out low level noise from sound enabler 12, a compandor 152 (Phillips/Signetics NE575) has been designed into the receiver circuit. The ISD1020 (chip enabler 12) has a differential speaker output. Both the positive and the negative outputs of the speaker lines (SP+ and SP−) of sound enabler 12 are fed into compandor 152. In addition, R7 (1K Potentiometer) is used as a "gain" adjustment for sound in order to allow the user to adjust the clarity of the sound effects. The output of compandor 152 is AC coupled through C5, divided in half by resistors R9 and R10, and AC coupled through C6 then fed into audio amplifier 156 (LM386—Phillips). R11 (10k potentiometer) controls the amount of amplification (volume) of the sound. The output of audio amplifier 156 is then AC coupled through C7 into the speaker (SPKR). The power supply of audio amplifier (pin 6) is connected to the 9V battery to give audio amplifier 156 a much greater amplification range. Note: the speaker is only driven on a single side and the quality of the sound is much better because both differential signals (SP+ and SP−) from the sound enabler 12 have been fed into compandor 152.

The power supply for this circuit consists of a voltage regulator 160 (National Semiconductor 7805 5V Voltage Regulator) which is powered by a 9V battery. This regulator supplies five volts to all the components on the board except audio amplifier 156. The audio amplifier actually uses the 9V input from the battery as a supply to give a wider voltage range for amplification.

Figure 7:
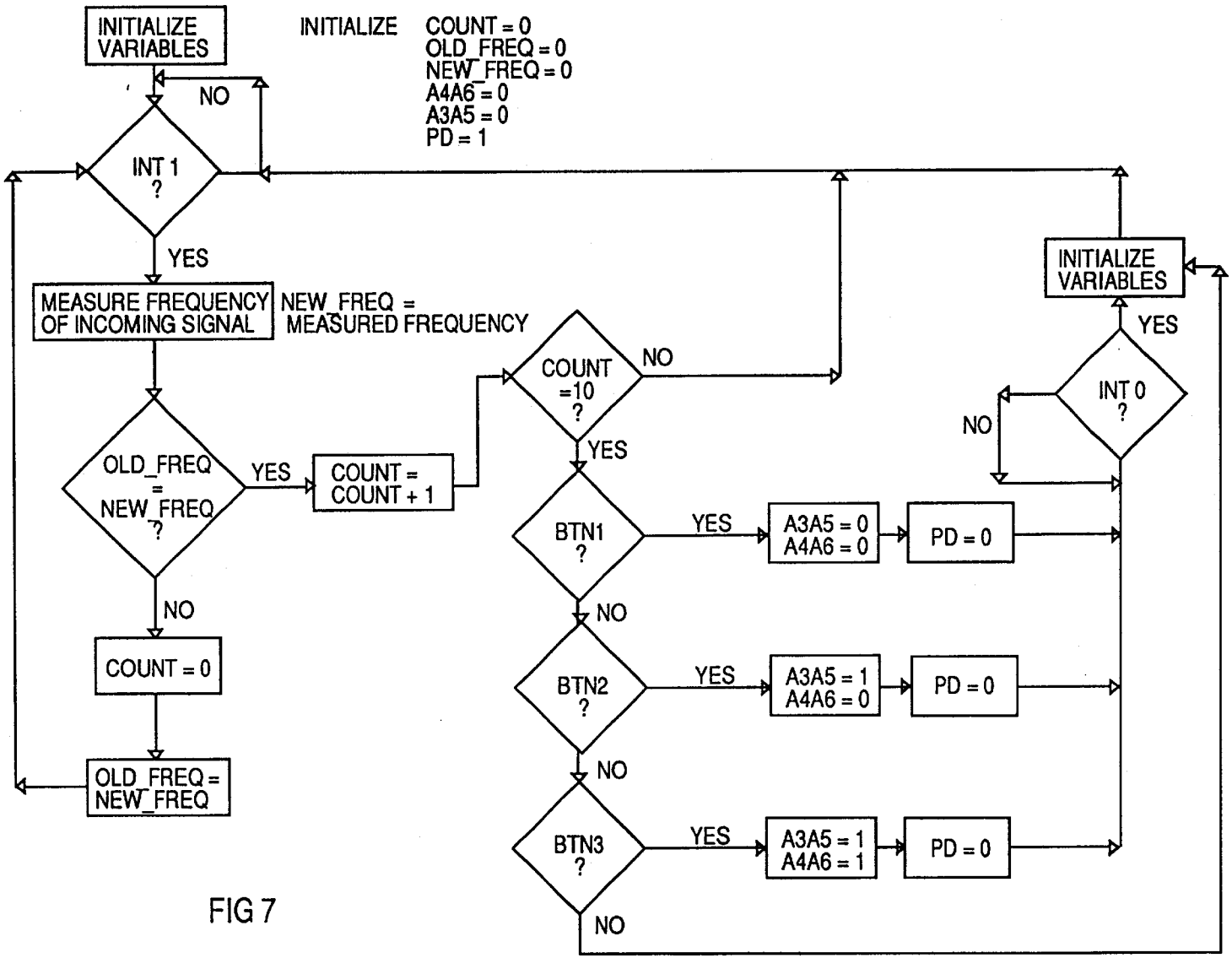
FIG. 7 shows a flow diagram to describe the program code for the receiver unit of the present invention.

FIG. 7 shows a flow diagram of the code for receiver 28. The code begins by initializing control signals A3A5 and A4A6 to low and the PD signal (Power Down) to high. As long as the PD signal is high, the sound enabler chip remains powered down. The code initializes all other variables, OLD_FREQ, NEW_FREQ, and COUNT, to zero. OLD_FREQ defines the frequency of the latest incoming signal. COUNT defines the number of times the code consecutively measures the same signal frequency. After consecutively measuring the same frequency 10 times, the code will play the sound effect located in memory as defined by address lines A0–A7.

After initialization, microcontroller 136 continuously waits for the /INT1 (Interrupt 1) signal to transition low. This line will transition low when receiver 28 detects an infrared signal. The microcontroller then measures the frequency of the incoming signal on the /INT1 line. Once measured, the code sets NEW_FREQ to this value. The code then compares this frequency value to OLD_FREQ to see if the two are equal. If not, the code resets COUNT to zero and OLD_FREQ is set equal to NEW_FREQ. Microcontroller 136 will then wait for the next signal. If OLD_FREQ and NEW_FREQ are the same, the code increments COUNT and compares the value of COUNT to 10. If COUNT does not equal 10, microcontroller 136 waits for another incoming signal. If COUNT equals 10, the code checks the frequency to see which sound effect to play.

If the frequency is either 1 KHz, 500 Hz or 250 Hz, A3A5 and A4A6 signals are set to the proper address so the sound enabler chip can play the correct sound effect. Once A3A5 and A4A6 are set, PD transitions low and the sound enabler chip actually plays the desired sound effect message. Microcontroller 136 then waits for /INT0 (Interrupt 0) to transition low, which indicates an End of Message (EOM) signal. When the /EOM signal transitions low, the code reinitializes all variables and microcontroller 136 waits for a new incoming infrared signal. If the measured frequency of the incoming signal is not 1 KHz, 500 Hz or 250 Hz, microcontroller 136 reinitializes the variables and waits for the next incoming signal.

Figure 8:
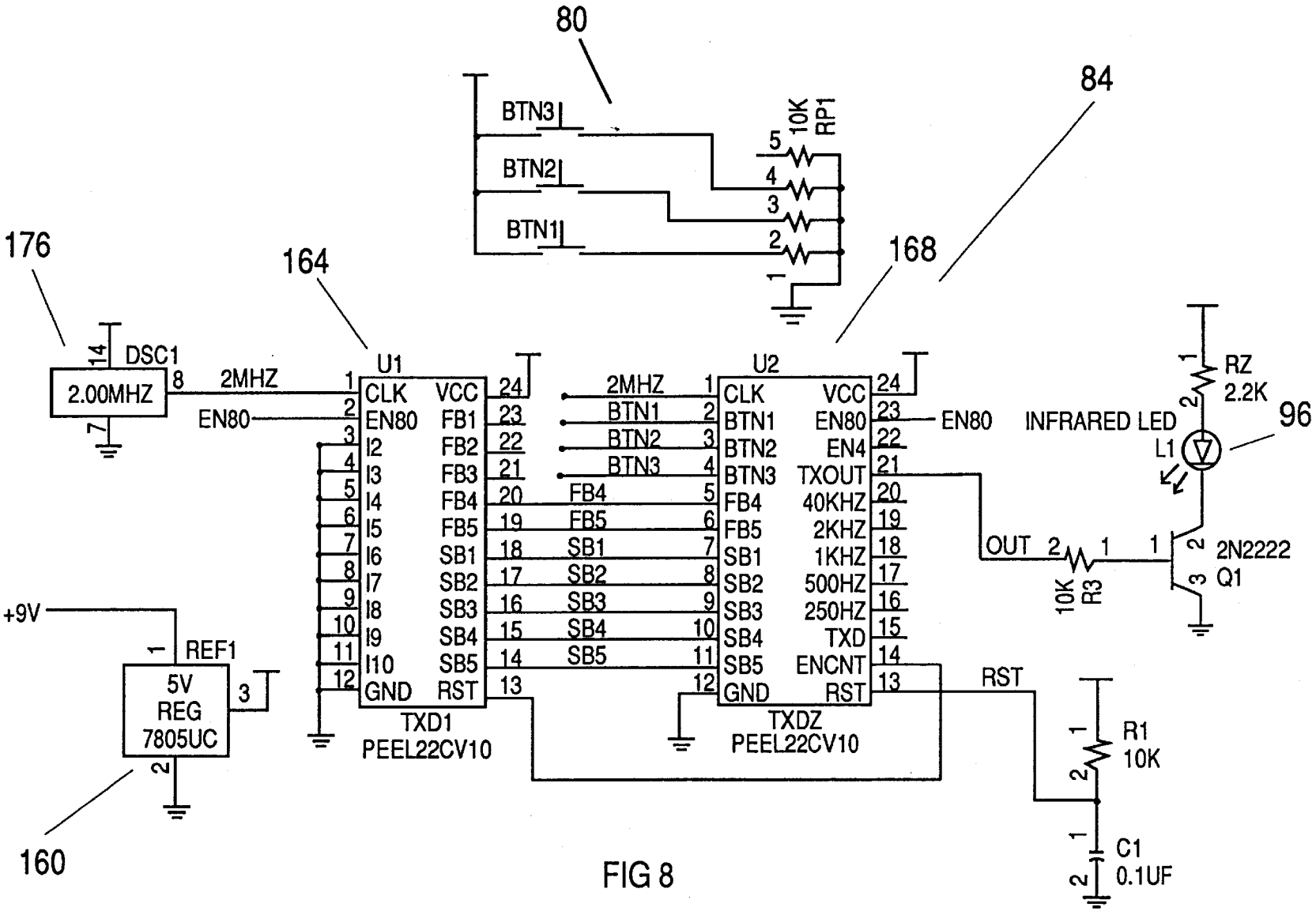
FIG. 8 shows a schematic diagram of the transmitter unit of the present invention.

FIG. 8 shows a schematic for the transmitter circuitry. The function of the transmitter is to modulate an infrared LED (Light Emitting Diode) 96 in order that infrared detector 44 of receiver 28 can detect the incoming signal. The specifications for this infrared detector 44 (Sharp GPU1U57X) requires that infrared LED 96 be modulated at 40 KHz for at least 400 microseconds. In addition, transmitter 76 needs to send three different signals, to accommodate three different sound effects, to receiver 28 depending upon which trigger switch 80 the user presses. To accomplish this, each trigger switch 80 produces a different signal: BTN1 (Button 1) produces a 1 KHz signal, BTN2 produces a 500 Hz signal, and BTN3 produces a 250 Hz signal. The circuitry then modulates each with a 40 KHz carrier signal.

The chips used to accomplish this task are two Programmable Electrically Erasable Logic (PEEL) units 164 and 168 (AMD PEEL22CV10). BTN1, BTN2, and BTN3 are grounded on one side via fixed resistance RP (resistor pack) and coupled to VCC on the other side. Each trigger switch 80 connects to inputs on the PEEL 168 (Pins 2, 3, and 4). When the user presses any one of the trigger switches, the logic level of the corresponding input transitions high causing ENCNT on PEEL 168 (pin 14) to transition high. ENCNT of PEEL 168 also connects to the active low reset line on PEEL 164 (pin 13). Thus, the user enables PEEL 164 by pushing any of the trigger switches.

Both PEEL's 164 and 168 use a 2.00 MHz oscillator for a clock source (PEEL 164 pin 1 and PEEL 168 pin 1). Once enabled by the ENCNT signal of PEEL 168, two five bit counters FB1–FB5 and SB1–SB5 (Fast Binary Count, Slow Binary Count respectively) begin dividing the 2 MHz down to the required frequencies: 40 KHz, 1 KHz, 500 Hz, and 250 Hz. FB1–FB5 counts from 01–24 dividing the 2 MHz by 25 producing a signal 1 clock pulse wide (0.5 microseconds) at a frequency of 80 KHz called EN80 (Enable). FB5 and FB4, generated in PEEL 164 and fed into PEEL 168 (pins 5 and 6 respectively), are used to create the EN80 signal. This EN80 signal feeds back into PEEL 164 (Pin 2) and is used to gate the second five bit counter SB1–SB5 which counts from 0–19 dividing the 80 KHz by 20 down to create a signal one clock pulse wide (0.5 microseconds) at a frequency of 4 KHz called EN4. SB1–SB5, generated in PEEL 164 (pins 18–14) and fed into PEEL 168 (pins 7–11) to create the EN4 signal.

The EN80 and EN4 signals within PEEL 164 are divided by two and given a 50% duty cycle to create the 40 KHz signal (PEEL 168 pin 19) and the 2 KHz (PEEL 168 pin 19) signal respectively. The 2 KHz is then divided by two to create a 1 KHz signal (PEEL 168 pin 18) which is further divided by two to create the 500 Hz signal (PEEL 168 pin 17). The 500 Hz signal is then divided by two creating the 250 Hz signal (PEEL 168 pin 16). The modulation circuit then uses these signals to transmit the required waveform, which is indicative of the desired sound effect, as described above.

The TXD (Transmission) signal of PEEL 168 (pin 15) is the base frequency (1 KHz, 500 Hz, and 250 Hz) without the 40 KHz carrier frequency. If the user presses BTN1, TXD is a 1 KHz square wave; if the user presses BTN2, TXD is a 500 Hz square wave, and if the user presses BTN3, TXD is a 250 Hz square wave. If the user presses more than one trigger switch, BTN1 takes priority over BTN2 which takes priority over BTN3. TXOUT (Transmission Out) of PEEL 168 (pin 21) combines the TXD signal with the 40 KHz signal and feeds the resulting signal into the modulator circuit. Note, that an automatic reset, (PEEL 168, pin 13) connects to VCC via fixed resistance R1 and couples to ground via C1. This permits the necessary low pulse to reset PEEL 168. Also note, all unused inputs on PEEL 164 (pins 3–12) tie to ground.

The TXOUT signal from PEEL 168 (pin 21) couples to the base of transistor Q1 via fixed resistance R3. The emitter of transistor Q1 connects to ground. The collector of the transmitter Q1 connects to the infrared LED 96 which couples to VCC via fixed resistance R2. When the 40 KHz square wave goes into the base of the transistor Q1, transistor Q1 turns on and off at a frequency of 40 KHz, this causes the infrared LED 96 to pulse at a frequency of 40 KHz. When the TXOUT signal is low (no 40 KHz signal out) the transistor turns off, turning infrared LED 96 off. Both R2 and R3 are used for current limits.

The power supply for this circuit consists of voltage regulator 160 (National Semiconductor 7805 5V Voltage Regulator) which utilizes a 9V battery. This voltage regulator 160 supplies five volts to all the components on the board.

This embodiment employs infrared technology to transmit instruction signals to the receiver; however, other wireless technologies such as radio frequency (i.e.: radio control) and sound energy (i.e.: ultrasonic), or even wired versions, can be used to transmit a signal and perform the same functions. In addition, the sound cartridge could be modified to fit on an integrated circuit board. This board could be encased and designed to plug into the receiver and perform the same functions.

Figure 9:
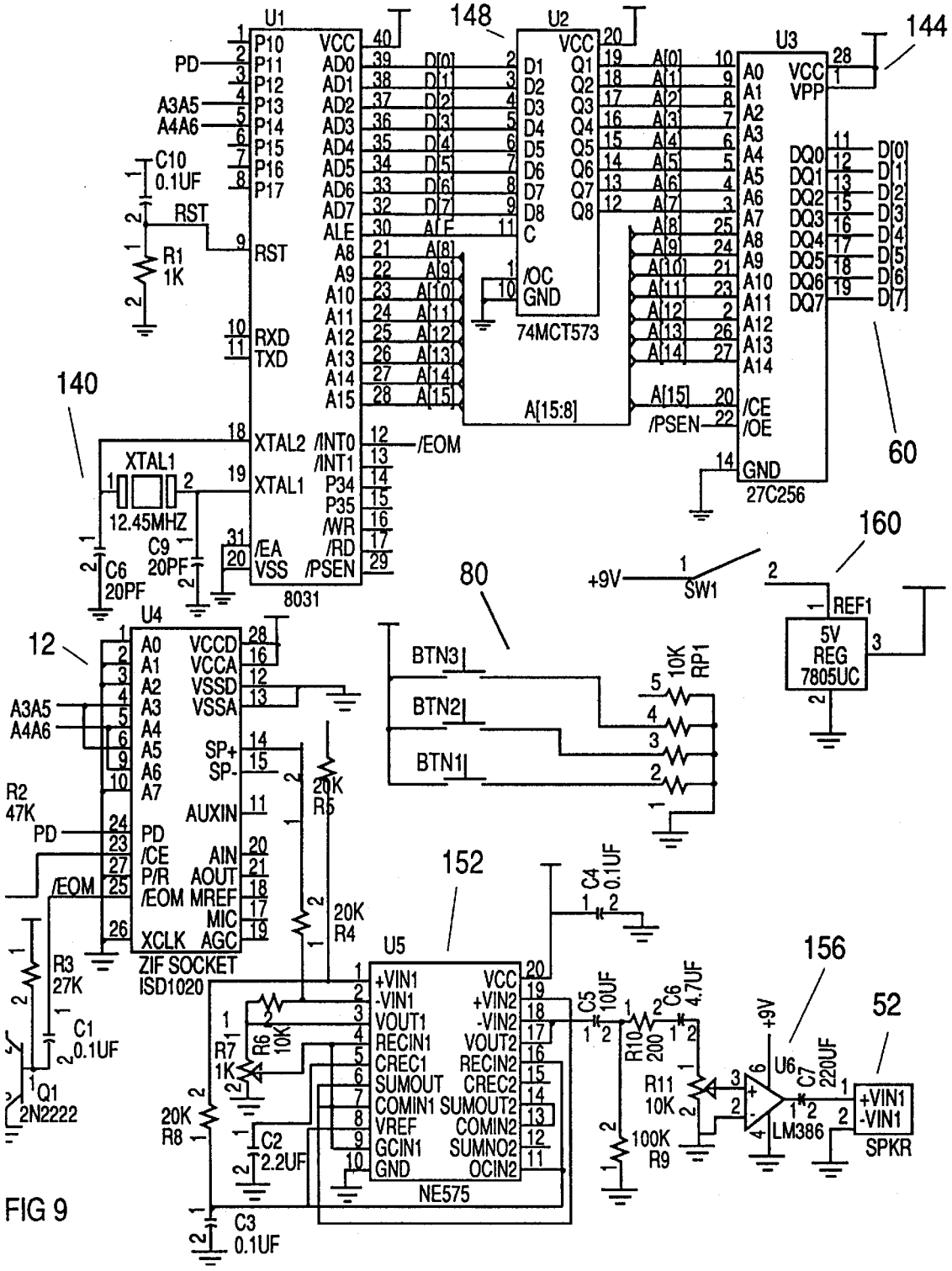
FIG. 9 shows a schematic diagram of the another modification of the present invention.

FIG. 9 is a schematic drawing showing the one-piece embodiment 1 of the present invention. The microcontroller 136 used is an Intel 8031 microcontroller which requires the following circuitry: reset circuitry, external crystal, instruction fetch circuitry, and interrupt circuitry.

As seen in FIG. 9, microcontroller 136 uses an on-chip oscillator as the clock source for the CPU. This clock source can be achieved by connecting a crystal resonator 140 between the XTAL1 and XTAL2 pins of microcontroller 136 and capacitors C8 and C9. This embodiment also employs a 12 MHz crystal to create a machine cycle time of 1 microsecond. In addition, reset circuit within the receiver circuit allows microcontroller 136 to function properly when powered up. An automatic reset function is obtained by connecting VCC to the RST pin of microcontroller 136 via C10 and R1. To ensure proper reset, the RST pin on microcontroller 136 must remain high during the oscillator start-up period (normally a few microseconds plus two machine cycles (2 ms)).

The instruction fetch circuitry allows microcontroller 136 to fetch instructions from external memory 144 (in this application an AMD 27C256 EPROM is used to store the instructions). To implement, the /EA pin on microcontroller 136 ties to ground which causes the microcontroller to fetch all program instructions from external memory 144 (ROM).

Again, microcontroller 136 memory is divided into two groups: data memory and program memory (CPU instructions). In this application, all data is stored in the 384 bytes of internal RAM onboard microcontroller 136. Bus functions during program memory fetches are dedicated to the 16 I/O (Input/Output) lines AD0–AD7 and A8–A15 (Address/Data, Address respectively) of microcontroller 136. AD0–AD7 of microcontroller 136 serves as a time-multiplexed address/data bus. These bus lines carry the low byte of the program counter. The program counter is a register that contains the full address of the next program instruction. The program counter is built within the 8031 Microcontroller. During the time that the low byte of the Program Counter is valid on AD0–AD7, the signal ALE (Address Latch Enable) of microcontroller 136 clocks this byte into an address latch 148 (Texas Instrument 74HCT573). Meanwhile, A8–A15 of microcontroller 136 emit the high byte of the Program Counter. During this exchange, /PSEN (Program Store Enable) of the external memory 144 strobes the external memory (EPROM) 144 and the code byte is read into microcontroller 136. It must be noted that the Program Memory addresses are always 16 bits wide, however, in this application, A15 is used for the chip select (/CE) on the external memory 144 device.

There are also three trigger switches 80 associated with this embodiment which the user employs to select the desired sound effect. These trigger switches 80 (BTN1, BTN2, and BTN3) connect to VCC on one side and to ground via fixed resistant pack RP1 on the other side. In addition, trigger switches 80 connect to Port 1 on microcontroller 136 (pins 6, 7, and 8). All pins on Port 1 are bit programmable; therefore, while pins 6, 7, and 8 are serving as inputs, control lines A3A5, A4A6 and PD serve as outputs. Microcontroller 136 constantly monitors the status of the trigger switches 80. When the user pushes one of the trigger switches 80, the logic level at the corresponding port pin transitions high and address lines A3A5 and A4A6 of sound enabler 12 (ISD 1020 sound chip) are set to the memory address where the desired sound effect is stored. The sound enabler 12 will play the desired sound effect when the PD signal transitions low.

As for the interrupt circuitry, /INTO connects to the /EOM (End of Message) signal of sound enabler 12 (ISD 1020 sound chip). At the end of each message, /EOM transitions low causing Interrupt 0 to occur. Once a message begins playing, microcontroller 136 will wait until Interrupt 0 occurs before it begins monitoring the trigger switches for another incoming signal; this ensures the sound effect device will complete the current sound effect message.

Sound enabler 12 within the sound cartridge 4 plugs into a 28 pin ZIF (Zero Insert Force) socket 36 within receiver 28. In addition, sound enabler 12 should be positioned within sound cartridge 4 such that pin 1 of sound enabler 12 aligns with pin 1 of ZIF socket 36. This can be accomplished by aligning the pins of sound enabler 12 with the corresponding pin positions in sound cartridge 4. Since the sound cartridge is designed for "one-way" fit, sound enabler 12 is guaranteed to be inserted correctly into receiver 28. Receiver 28 will be capable of playing a variety of sounds since sound cartridge 4 and sound enabler 12 can be easily removed via the ZIF socket from the circuit and exchanged with a new sound cartridge 4 and sound enabler 12. The sound enabler 12 used in this application (ISD 1020 sound chip) can accommodate up to twenty seconds of recorded sound. In addition, this sound enabler 12 is designed to allow for a variety of sound effects each being stored at different memory locations within sound enabler 12. Sound enabler 12 also has the capability to drive 50 milliwatts into a 16 ohm speaker. In this application, the sound is prerecorded on the sound chip using addresses lines A3A5 and A4A6. To play a particular sound, address lines A0–A7 of sound enabler 12 must be set to the correct address. In this application address lines A3 and A5 of sound enabler 12 connect to the A3A5 signal and address lines A4 and A6 connect to the A4A6 signal of microcontroller 136. The memory map of the sound chip is as follows:

| Message | Message Length | A3A5 Logic Level | A4A6 Logic Level |
|---|---|---|---|
| 1 | 10 sec | 0 | 0 |
| 2 | 5 sec | 0 | 1 |
| 3 | 5 sec | 1 | 1 |

A3A5, A4A6, and the PD signal connect to Port 1 (Pins 1–8) of microcontroller 136, thus microcontroller 136 controls all the signals necessary to produce the messages stored in sound enabler 12.

In addition, this embodiment also employs message looping circuitry for those instances where the user plays the same message repetitively. This circuit uses the /EOM and ICE (Chip Enable) signals of sound enabler 12. As seen in FIG. 9, C1 connects the /EOM signal to the base of transistor Q1. In addition, the base of transistor Q1 connects to VCC via fixed resistance R3. The emitter of transistor Q1 is grounded and the collector of transistor Q1 connects to VCC via fixed resistance R2 with pin 2 of R2 connecting to the /CE pin on sound enabler 12.

If the sound effect message is playing, /EOM remains in a high logic level state and transistor Q1 is turned on. This causes the /CE pin to transition low. At the end of each message, the /EOM signal transitions low. This low signal, coupled through C1, causes transistor Q1 to momentarily turn off. This creates a positive going pulse on the /CE line, which in turn causes sound enabler 12 to momentarily turn off. R3 will then cause the base of transistor Q1 to transition high, causing transistor Q1 to turn on, which in turn produces a low on the /CE line. This turns sound enabler 12 on which will now begin playing the sound effect message located at the address defined by address lines A0–A7. As sound enabler 12 turns off and on the same message is replayed, assuming A0–A7 have not changed.

To filter out low level noise, the design incorporates a compandor 152 (Phillips/Signetics NE575). The ISD1020 (chip enabler 12) has a differential speaker output. Both the positive and the negative outputs of the speaker lines (SP+ and SP−) of sound enabler 12 feed into compandor 152. In addition, the design employs R7 (1K Potentiometer) as a "gain" adjustment for sound, thus allowing the user to adjust the clarity of the sound effects. The output of compandor 152 is AC coupled through C5, divided in half by resistors R9 and R10, AC coupled through C6 and fed into audio amplifier 156 (LM386—Phillips). R11 (10k potentiometer) controls the amount of sound amplification (volume). The output of audio amplifier 156 is then AC coupled through C7 into the speaker 52 (SPKR). The power supply of audio amplifier 156 (pin 6) connects to a 9V battery to give audio amplifier 156 a much greater amplification range. Note: the speaker is only driven on a single side and the quality of the sound is much better because both differential signals (SP+ and SP−) from the sound enabler 12 feed into compandor 152.

The power supply for this circuit consists of a voltage regulator 160 (National Semiconductor 7805 5V Voltage Regulator) which is powered by a 9V battery. This regulator supplies five volts to all the components on the board except audio amplifier 156. Audio amplifier actually uses the 9V input from the battery as a supply to give it a wider voltage range for amplification.

Figure 10:
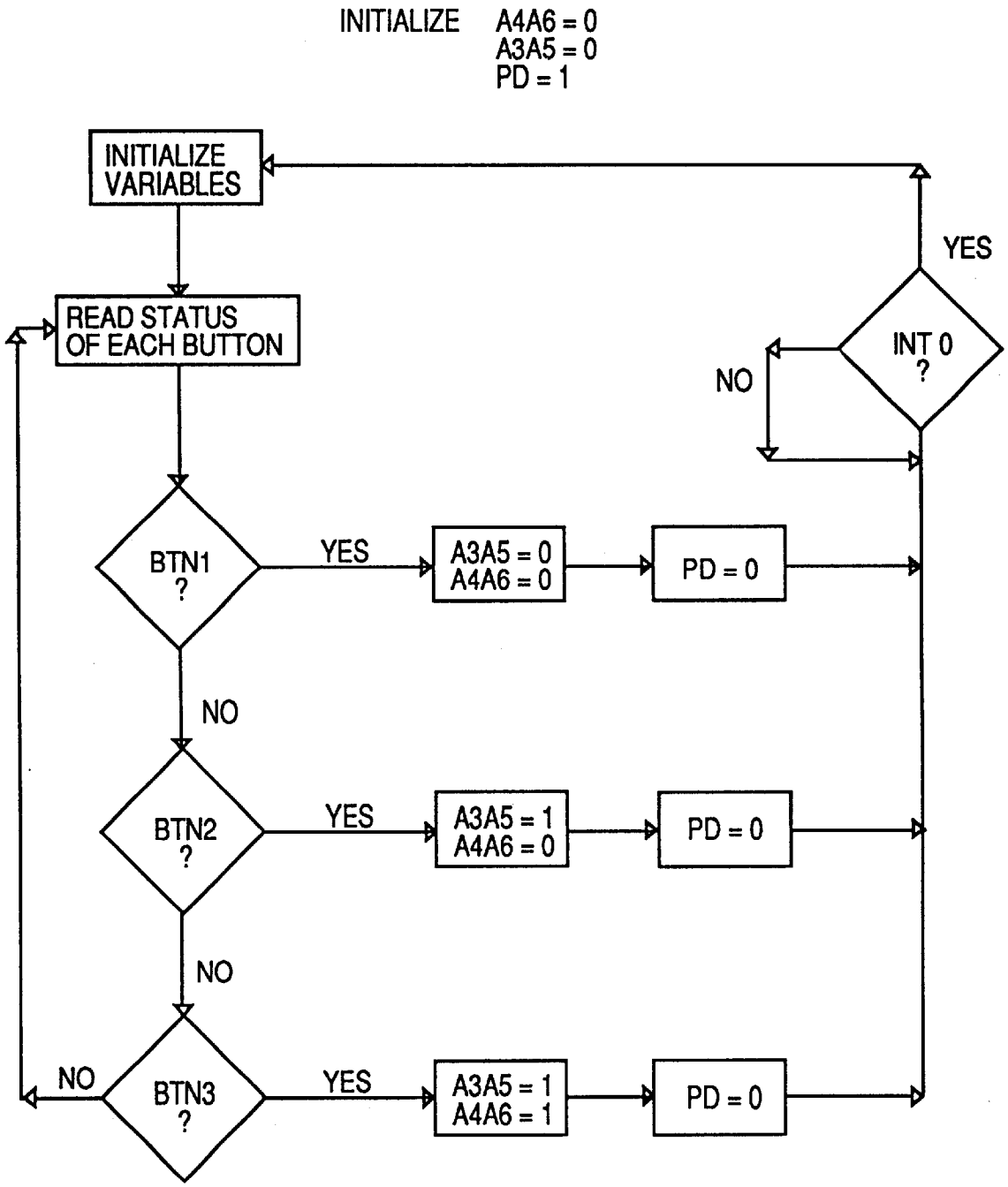
FIG. 10 is a flow diagram to describe the code for another modification of the present invention.

FIG. 10 shows a flow diagram of the code for the one-piece embodiment. The code begins by initializing control signals A3A5 and A4A6 to a low logic level and the PD signal to a high logic level, which keeps the chip powered down. Once this is complete, the microcontroller begins monitoring the status of the three trigger switches (BTN1, BTN2, and BTN3).

If the user does not press any of the trigger switches 80, microcontroller 136 will continue monitoring their status. If the user does press any of the trigger switches 80, the code sets A3A5 and A4A6 to the proper address and then sets PD (Power Down) low. When PD transitions low, the sound enabler plays the desired sound effect message. Microcontroller 136 then waits for /INT0 (Interrupt 0) to transition low, which indicates an End of Message (EOM) signal. Once an End of Message signal occurs, the code resets the variables and microcontroller 136 once again begins monitoring the status of the trigger switches 80.

Although the circuits described above for both the two- and one-piece embodiments use integrated circuitry to perform their functions, it would be possible to replace the integrated circuitry with discrete circuitry and components to obtain greater compactness.

Operational Description

When using the two piece embodiment, the user must first slip glove 92 over the preferred hand until his/her fingers and thumb fit properly inside glove 92. To adjust glove 92, the user will pull and fasten Velcro straps 108 until they achieve a comfortable fit. After the adjustments have been made, the user should make sure that the infrared LED 96 of transmitter 76 is centered on the user's forearm in order to properly transmit the infrared signal to receiver 28. At this point, the user will turn transmitter 76 on by switching off/on switch 116 to the "on" position.

The user will then attach receiver 28 to his/her waist. The user must first wrap belt unit 72 equipped with receiver 28 around his/her waist and snap and secure the belt buckle 73. Adjustments can be made by lengthening or shortening the belt adjuster 74 until a snug fit is obtained. The user will then position receiver 28 on the same side as the gloved hand. This will aid in the detection of the infrared signal. The user will then plug sound cartridge 4 into receiver 28 by inserting the proper insert extensions 24 into the corresponding cartridge chamber 32 of receiver 28. Once this is complete, the user will press arm lock 40 down to connect sound enabler 12 into driving means 60 of receiver 28. At this point, the user may turn receiver 28 on by switching off/on switch 68 to the "on" position.

To play a sound effect from the two piece embodiment 1, the user must depress one of the trigger switches 80 on glove 92 which will transmit an infrared signal to receiver 28. Depending on which trigger switch 80 the user presses, transmitter 76 will send instructions to driving means 60 of receiver 28 to play the desired sound effect. For example, as the user is playing with his/her toy, the user can move or grab the object and simply push trigger switch 80 to produce a desired sound effect in the middle of play. This unit allows the user to freely interact and control the sound effects without having to stop and interrupt play.

If the user wishes to change sound effects, the user must release arm lock 40 by digging his/her finger under finger depression 54 and lifting arm lock 40 upward. This will disconnect sound cartridge 4 and sound enabler 12 from driving means 60 of receiver 28. The user may now pull the "old" sound cartridge 4 out and reinsert a "new" sound cartridge 4 containing new sound effects into receiver 28.

When the user is finished, he/she may turn both receiver 28 and transmitter 76 off by switching off/on switch 68 and 116 respectively to the "off" position. The user will unhook the belt unit 72 from his/her waist and loosen the Velcro straps 108 of glove 92 to remove from the user's hand.

If manufacturers produce toys that are designed to fit receiver 28 within their toys, the user must first snap or fit receiver 28 into the manufacturer's design. The operation instructions will be the same with the exception that the user will not wear receiver 28 around his/her waist. However it is important to note that infrared detector 44 should be within the line of sight of infrared LED 96.

The one piece embodiment 120 resembles the same operation instructions as the two piece embodiment 1, however, it can be incorporated into many other devices and toys. For example, one piece embodiment 120 can be used in story books, figurines, toys and other entertainment type products to provide interchangeable sound effects. Even though the receiver and transmitter functions in the two-piece embodiment are replaced with internal circuitry in the one-piece embodiment, the operational description is basically the same. For example, one piece embodiment 120 can be mounted to a glove or story book. In both cases, the user will add sound effects by plugging sound cartridge 4 into the cartridge chamber 32 by inserting the proper insert extensions 24 into the corresponding cartridge chamber 32 of one piece embodiment 120. Once this is completed, the user will press arm lock 40 down to connect sound enabler 12 into driving means 122 of one piece embodiment 120. At this point the user may turn the one piece embodiment 120 on by switching off/on switch 124 to the "on" position.

To play a sound effect with the one piece embodiment 120, the user must depress one of the trigger switches 80. Depending on which trigger switch 80 the user presses, microcontroller 136 will send instructions to play the desired sound effect.

Again, as previously mentioned, the user can change sound effects by releasing arm lock 40. The user must first dig his/her finger under finger depression 54 and lift arm lock 40 upward. This will disconnect sound cartridge 4 and sound enabler 12 from driving means 122 of one piece embodiment 120. The user may now pull the "old" sound cartridge 4 out and reinsert a "new" sound cartridge 4 containing new sound effects into one piece embodiment 120.

When finished, the user may turn off the one piece embodiment 120 by switching the off/on switch 124 to the "off" position.

Conclusion

The description of the preferred embodiments of the present invention should not be construed as a limitation on the overall scope of the invention. Other embodiments, design features, and applications, some of which were already mentioned in the specification, are certainly feasible. For example, the present design could be modified so that two or more sound cartridges and sound enablers can be simultaneously used in order to add and combine additional sounds for different effects. In order to use a plurality of cartridges, the device could be constructed with two or more sockets in the receiver. Alternately, a cartridge holder could be designed that would fit into the current socket. The cartridge holder would hold one, two, or more cartridges. Depending on the design of the holder, the user could choose which cartridge was in use by physically rotating a part of the holder, pressing a button, moving a lever, or any other desired method. A different design of holder could select more than one cartridge for use at one time, either by playing multiple sounds for a particular signal, or having additional actuators to indicate the particular cartridge or sound effect.

The device disclosed could also be used for other types of information. For example, the buttons on the gloves could be used to give controls to a remote control. In this case, the output from the interchangeable chip would be instructions to the remote control car.

I claim:

1. An interchangeable sound effect device comprising:

an interchangeable sound cartridge containing at least one sound effect, a selector for selecting a signal indicative of a selected sound effect, a transmitter configured to transmit said signal, a receiver configured to receive and interpret said signal, and a speaker electronically connected to the receiver.

2. The interchangeable sound effect device of claim 1 wherein said interchangeable sound cartridge is a sound enabler integrated circuit for storing a plurality of sounds and accessing each of said sounds by storing said sounds in a partitioned segment of memory within said sound enabler integrated circuit.

3. The interchangeable sound effect device of claim 2 wherein said interchangeable sound cartridge is further comprised of:

connector extensions for connecting said sound enabler integrated circuit to said receiver, and a clamping device for securing said sound cartridge to said receiver.

4. The interchangeable sound effect device of claim 1 wherein said at least one sound effect is a plurality of sound effects and wherein said selector has a plurality of triggers for selecting one of said plurality of sound effects.

5. The interchangeable sound effect device of claim 1 wherein said transmitter is mounted in a glove-like garment to be worn by a user.

6. The interchangeable sound effect device of claim 1 wherein said receiver has a sound cartridge chamber with a zero-insertion-force socket configured to receive said sound cartridge.

7. The interchangeable sound effect device of claim 1 wherein said transmitter is housed in a wearable article.

8. The interchangeable sound effect device of claim 1 wherein said selector is housed in a wearable article.

9. The interchangeable sound effect device of claim 1 used in combination with a unit chosen from a family of units comprising dolls, figurines, toys, games, and books.

10. The interchangeable sound effect device of claim 1 wherein said receiver and said speaker are housed in a unit designed to be worn around a user's waist.

11. The interchangeable sound effect device of claim 1 wherein said signal from said transmitter is one from a family of signals comprising infrared signals, radio frequency signals, and ultrasonic signals.

12. The interchangeable sound effect device of claim 1 wherein said interchangeable sound cartridge is easily removed by the user and exchanged with other interchangeable sound cartridges each containing a different set of sound effects to meet a given application.

13. The interchangeable sound effect device of claim 1 wherein said receiver, said interchangeable sound cartridge, and said speaker are physically housed within a single unit.

14. The interchangeable sound effect device of claim 13 wherein said single unit is designed to be worn around a user's waist.

15. A sound effect device comprising:

an actuator housed within a wearable article to be worn by a user, said actuator configured to emit a signal indicative of a selected prerecorded sound effect when said actuator is activated, a sound effect storage device for storing the selected prerecorded sound effect, a speaker, and a playback device configured to receive said signal from said actuator and for accessing and playing back the sound effect from said sound effect storage device in response to said signal.

16. The sound effect device of claim 15 further comprising a power supply and voltage regulator electronically connected to said speaker and said playback device.

17. The sound effect device of claim 16 wherein said voltage regulator is a 5 volt voltage regulator.

18. The sound effect device of claim 15 wherein said sound effect storage device comprises a sound enabler integrated circuit for storing a plurality of sounds, and accessing each of said sounds by storing said sounds in a partitioned segment of memory within said sound enabler integrated circuit.

19. The sound effect device of claim 15 wherein said sound effect storage device comprises an interchangeable sound cartridge for storing a plurality of sound effects.

20. The sound effect device of claim 15 wherein said article is a glove-like garment.

21. The sound effect device of claim 20 wherein said playback device is housed in a unit to be worn on the user's waist.

22. The sound effect device of claim 15 wherein said playback device is housed in said wearable article.

23. The sound effect device of claim 15 wherein said sound effect device is contained within a single unit.

24. A sound effect device comprising:

an actuator housed within a wearable article to be worn by a user, said actuator configured to emit a signal indicative of a selected prerecorded sound effect when said actuator is activated, a sound effect storage device for storing the selected prerecorded sound effect, a speaker, a playback device configured to receive said signal from said actuator and for accessing and playing back the sound effect from said sound effect storage device in response to said signal, and a signal transmitter configured to send said signal from said actuator to said playback device.

25. The sound effect device of claim 24 wherein said sound effect storage device comprises an interchangeable sound cartridge for storing a plurality of sound effects.

26. The sound effect device of claim 25 wherein said interchangeable sound cartridge has a sound enabler integrated circuit for storing and accessing said plurality of sound effects in digital form.

* * * * *